US005676575A

United States Patent [19]

Fukuda et al.

[11] Patent Number: 5,676,575

[45] Date of Patent: Oct. 14, 1997

[54] EXHAUST SYSTEM FOR WATERCRAFT

[75] Inventors: Yoshihide Fukuda; Shigeyuki Ozawa, both of Hamamatsu, Japan

[73] Assignee: Sanshin Kogyo Kabushiki Kaisha, Shizuoka, Japan

[21] Appl. No.: 648,422

[22] Filed: May 15, 1996

Related U.S. Application Data

[62] Division of Ser. No. 399,055, Mar. 8, 1995, Pat. No. 5,556,314.

[30] Foreign Application Priority Data

Mar. 8, 1994 [JP] Japan ..... 6-62191

[51] Int. Cl.[6] ..... B63H 21/32

[52] U.S. Cl. ..... 440/89; 114/270

[58] Field of Search ..... 440/38, 47, 89; 181/212, 235, 239, 259, 260; 114/270; 60/221, 310

[56] References Cited

U.S. PATENT DOCUMENTS

| | | | |
|---|---|---|---|
| 2,935,039 | 5/1960 | Thompson | 440/89 |
| 3,742,895 | 7/1973 | Horiuchi | 440/89 |
| 4,274,357 | 6/1981 | Dawson | 440/89 |
| 4,601,666 | 7/1986 | Wood, Jr. | 440/89 |
| 4,631,032 | 12/1986 | Nishida | 440/89 |
| 4,643,685 | 2/1987 | Nishida | 440/89 |
| 4,689,026 | 8/1987 | Small | 440/69 |
| 4,989,409 | 2/1991 | Nakase et al. | 440/89 |
| 5,007,870 | 4/1991 | Okubo et al. | 440/89 |

FOREIGN PATENT DOCUMENTS

| | | | |
|---|---|---|---|
| 0282462 | 9/1988 | European Pat. Off. | 440/89 |

*Primary Examiner*—Edwin L. Swinehart
*Attorney, Agent, or Firm*—Knobbe, Martens, Olson & Bear, LLP

[57] ABSTRACT

A number of exhaust systems for watercraft propelled by a propulsion unit contained within a tunnel formed in the underside of the hull. This tunnel has an opening through the side of the hull and exhaust gases are delivered to the tunnel from the engine through an exhaust system having an exhaust opening communicating with the tunnel. Various flow controlling arrangements are provided for controlling the flow through one or all of the openings so as to assist in exhaust silencing without significantly increasing back pressure.

18 Claims, 9 Drawing Sheets

EXHAUST SYSTEM FOR WATERCRAFT

This application is a Division of Ser. No. 08/399,055 filed Mar. 8, 1995, now U.S. Pat. No. 5,556,314.

BACKGROUND OF THE INVENTION

This invention relates to an exhaust system for a watercraft and more particularly to an improved high efficiency exhaust system that provides effective silencing with minimum back pressures.

It is well known that the control of the noise from engines that power watercraft presents significant problems. The reason for this is that the watercraft normally has a relatively limited area available for silencing devices. Thus, it is difficult to provide effective exhaust silencing for the exhaust gases of the powering internal combustion engine in a watercraft.

One way in which the watercraft exhaust gases are silenced is by discharging the exhaust gases or a portion of them below the level of water in which the watercraft is operated. In this way, the body of water acts as a silencing device.

Such arrangements, however, have several disadvantages. First, in planing type watercraft, the degree of submersion of the hull varies with the speed of travel. Thus, an exhaust discharge may be under water under some speeds but above water under other speeds. Thus, the silencing under all running conditions is difficult. Also, if the exhaust outlet is disposed so that it is under water under all running conditions, then, when the watercraft is travelling slowly, the discharge is so deeply submerged that the back pressure on the engine is too high.

In addition to these problems, there is also a danger that water may enter the engine through the exhaust system. This is obviously undesirable. Therefore, it is also the practice to employ water trap devices in the exhaust system for insuring against water intrusion into the engine. However, when the exhaust system outlet is submerged, the water trap devices may not be capable of totally protecting the engine.

In some type of watercraft, such as jet propelled watercraft, the jet propulsion unit is disposed in a tunnel that is formed on the underside of the hull and toward the rear of the hull. It has been the proposed to discharge the engine exhaust gases into this tunnel either above, at or below the water level therein. Where the discharge is below the water level, the aforenoted problems can occur. Where the discharge is above the water level, the tunnel itself may at times act as a resonating chamber and can actually amplify the noises rather than dampen them.

It is, therefore, a principal object of this invention to provide an improved exhaust system for a watercraft.

It is a further object of this invention to provide a watercraft exhaust system that provides effective silencing under all running conditions while insuring against water intrusion into the engine through the exhaust system.

It is a further object of this invention to provide an improved exhaust system for a watercraft wherein the exhaust gases are discharged into a tunnel in which the watercraft propulsion unit is contained but the exhaust gases are effectively silenced.

SUMMARY OF THE INVENTION

This invention is adapted to be embodied in an exhaust system for a watercraft having a hull that defines a tunnel in the underside thereof. This tunnel opens through a portion of the hull to provide a first opening. A propulsion device for the watercraft is positioned within the tunnel and propels the watercraft. An engine is disposed in the hull and drives the propulsion device. The engine includes an exhaust system which communicates at one end with the exhaust port of the engine and at the other end has a discharge opening that opens into the tunnel at a location spaced from its opening. Means are provided for restricting the flow through one of the openings under at least some conditions for providing silencing of the exhaust gases.

DETAILED DESCRIPTION OF THE PREFERRED EMBODIMENT OF THE INVENTION

Figure 1:
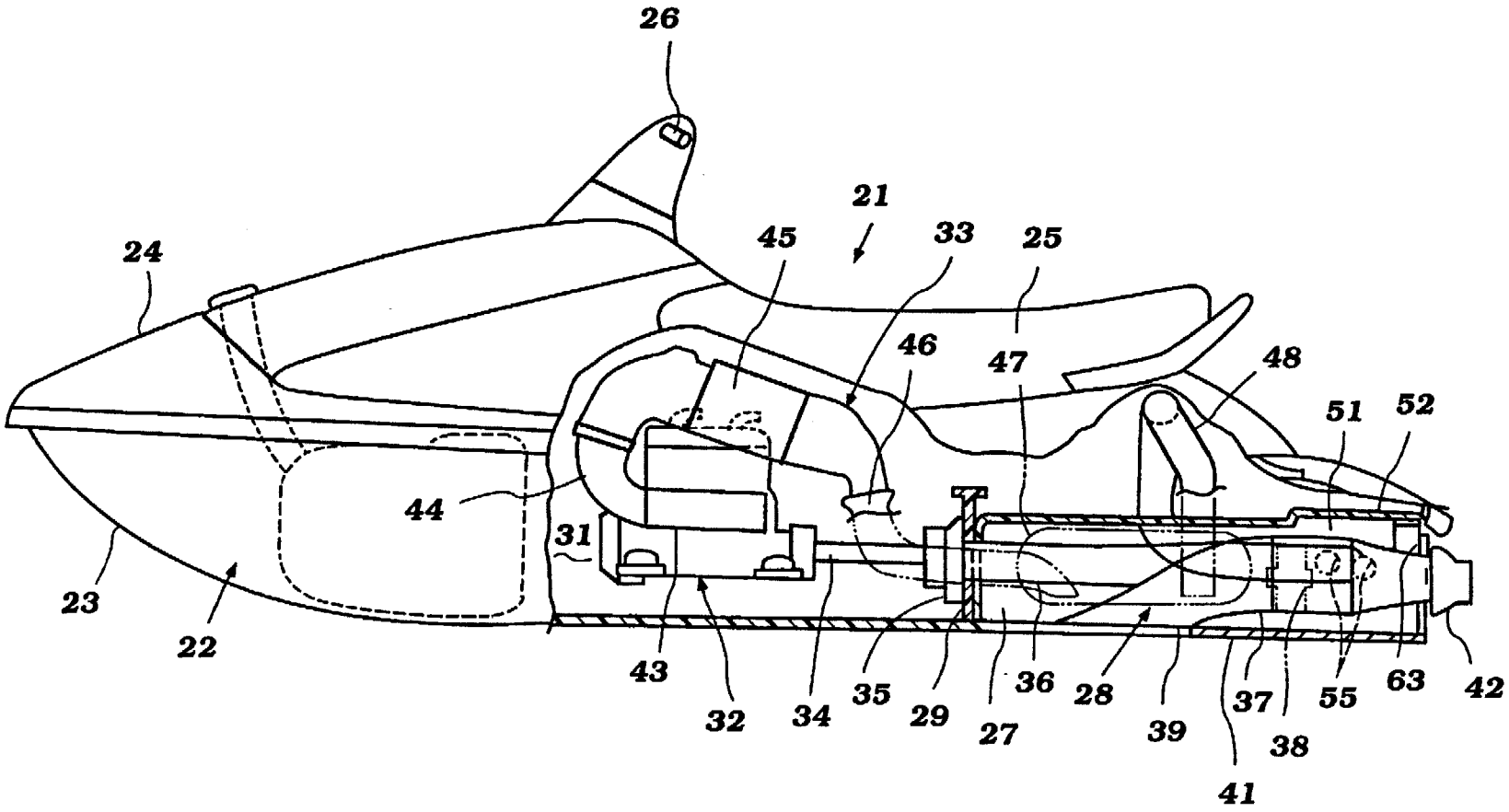
FIG. 1 is a side elevational view of a watercraft, with a portion broken away, constructed in accordance with a first embodiment of the invention.

Referring now in detail to the drawings and initially to the embodiment of FIGS. 1–5 and initially primarily to FIG. 1, a watercraft constructed in accordance with this embodiment of the invention is identified generally by the reference numeral 21. In the illustrated embodiment, the watercraft 21 is depicted as being of the so-called "personal type" that is designed to accommodate one or two riders seated in straddle tandem fashion. As will be readily apparent to those skilled in the art, the invention has utility with watercraft having a wide variety of configurations. The invention, however, has particular utility with personal watercraft due to their sporting nature and the fact that they are frequently propelled by jet propulsion units. It will be readily apparent, however, to those skilled in the art how the invention can be employed with any of a wide variety of types of watercraft.

The watercraft 21 is comprised of a hull, indicated generally by the reference numeral 22 and having a lower portion 23 and an upper deck portion 24. The deck portion 24 carries a seat 25 positioned to the rear of a controlling handlebar assembly 26. The seat 25 is designed, as noted, to accommodate one or more riders seated in straddle tandem fashion. Their feet will be disposed in foot areas on opposite sides of the seat 25 as is well known in this art.

The rear portion of the underside of the hull part 23 is formed with a tunnel 27 in which a jet propulsion unit, indicated generally by the reference numeral 28 is positioned. The forward end of the tunnel 27 is defined by a bulkhead 29 which separates it from an engine compartment 31 formed by the hull portions 23 and 24.

An internal combustion engine, indicated generally by the reference numeral 32 is supported in a known manner in the engine compartment 31. The actual configuration of the engine 32 may be of any known type but, in accordance with preferred embodiments of the invention, the engine 32 is of the water cooled type. Water for its cooling purposes is drawn from the body of water in which the watercraft 21 is operating and is discharged back to the body of water in which the watercraft is operating at least in part through the exhaust system for the engine 32. This exhaust system is indicated generally by the reference numeral 33.

The engine 32 has an output shaft that is connected in a known manner to a drive shaft 34 that extends rearwardly and which is journaled by a bearing 35 mounted on the front of the bulkhead 29. This shaft then continues through a tubular extension 36 of an outer housing assembly 37 of the jet propulsion unit 28. This shaft 34 is then coupled to an impeller shaft which drives an impeller 38 contained within the jet propulsion unit outer housing 37. The impeller 38 draws water through a water inlet opening 39 formed at the lower portion of the outer housing 37 and which cooperates with an underplate 41 of the hull 22. This water is then discharged rearwardly through a steering nozzle 42 which is controlled in a known manner by the handlebar assembly 26 for controlling the steering of the watercraft 21 in a well known manner.

The exhaust system 33 for the engine 32 is comprised of an exhaust manifold 43 which collects the exhaust gases from the exhaust ports of the engine. The exhaust manifold 43 communicates with a U-shaped pipe 44 at the front of the engine to deliver the exhaust gases to a combined expansion chamber and water jacket device 45 which receives cooling water from the engine and cools the exhaust system in a known manner. The expansion chamber device 45 communicates with an exhaust pipe 46 that delivers the exhaust gases to a water trap device 47 that is disposed in the hull 22 on one side of the tunnel 27. This water trap device 47 is provided, as is well known in the art, to assist in insuring that water that may enter the exhaust system through its outlet opening, to be described, cannot pass to the engine through the exhaust system.

A U-pipe 48 discharges the exhaust gases from the water trap device 47 into the tunnel 27 in a manner which will now be described by particular reference to the remaining figures of this embodiment (FIGS. 2–5).

It should be noted first that the tunnel 27 is defined not only by the bulkhead 29 but by a pair of vertically extending side walls 49 and 51 and a top wall 52. At its rear end, the tunnel 27 is generally open, except as will be noted. That is, the hull itself has an opening in its transom 52 that is generally coextensive with the tunnel 27.

Figure 2:
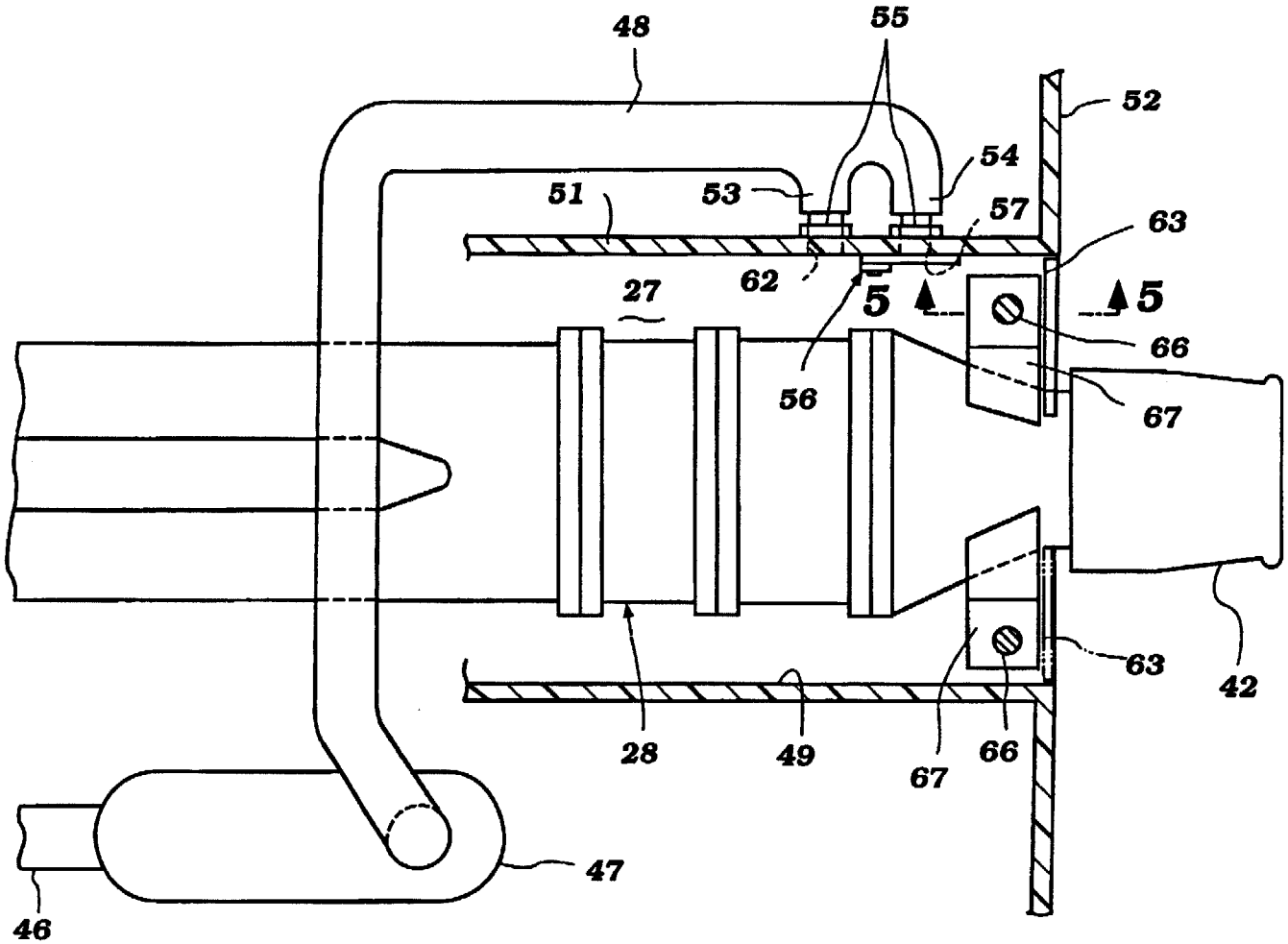
FIG. 2 is an enlarged cross-sectional view taken along a horizontal plane and shows the rear portion of the watercraft and a part of the exhaust system and propulsion unit for the watercraft.

As may be seen in these figures and particularly in FIG. 2, the U-pipe 47 extends from one side of the tunnel 27 adjacent its wall 49 across the top of the tunnel from the water trap device 47. The U-pipe 47 has a horizontally extending portion that has a pair of branch openings 53 and 54 which communicate with fittings 55 formed in the wall 51 and which open into the tunnel 27. The fittings 55 and branch sections 53 and 54 may be the same size or, alternatively, one of them may be smaller than the others. The section 54 and its fitting 55 is disposed closer to the transom 52 than the section 53 and its respective fitting 55.

A flap type check valve, indicated generally by the reference numeral 56 communicates with an opening 57 formed in the wall 51 that is aligned with the fitting 55. This flap type valve is comprised of an elastomeric valve element 58 that is fixed to the hull side 51 within the tunnel 27 by a retainer plate 59 and riveted type fasteners 61. The flap 58 normally is biased to its closed position as shown in solid lines in FIG. 4. This is the position that is maintained when the engine 32 is running at low and mid-range speeds so that the opening 57 and branch pipe 54 will be generally closed. All of the exhaust gases then flow through the branch pipe 53, its fitting 57 and a corresponding opening 62 (FIG. 2). As a result, the flow area is somewhat restricted and, hence, the exhaust gases will be well silenced.

Figure 4:
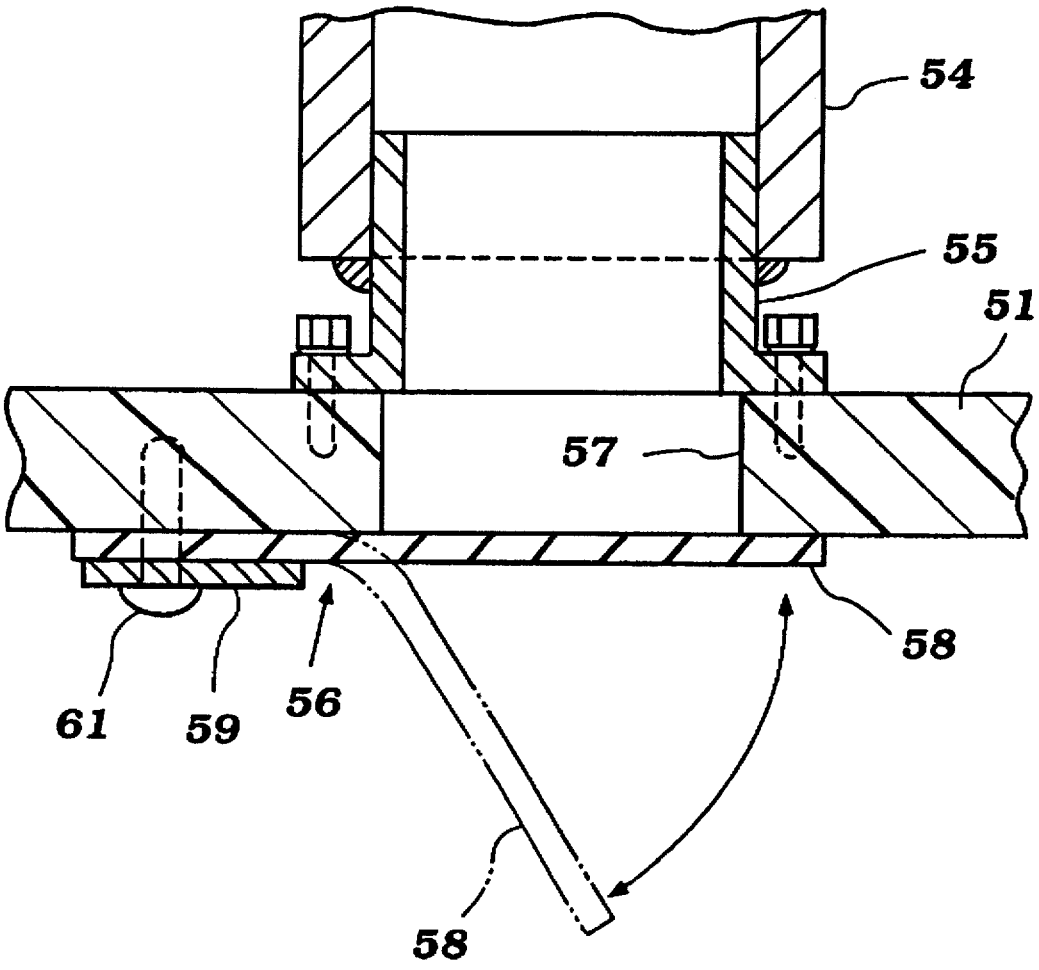
FIG. 4 is a further enlarged cross-sectional view taken along the line 4—4 of FIG. 3 and shows one of the silencing devices.

However, when the exhaust gas pressure becomes high enough due to increased engine speed, the flap type valve element 58 will move to its open position as shown in phantom lines in FIG. 4 and permit additional flow area to reduce back pressure. The valve element 58 will act to provide some silencing even when open.

It should also be noted that the exhaust gases will, at this stage, contain a fair volume of water which has been dumped back into the exhaust system somewhere upstream of the branch fittings 53 and 54 as is typical and well known in this art.

To provide additional silencing and preclude the emanation of exhaust sounds from reaching the occupants of the watercraft 21, there is provided a further flap type assembly which closes at least one half of the tunnel opening in the transom 52 on the side adjacent the branch sections 53 and 54. This flap type valve is comprised of an elastomeric flap valve element 63 that is affixed to the upper hull wall 52 by means of a retainer plate 64. The retainer plate 64 is affixed by fasteners 65 to the upper end of the flap plate 63. The bracket 64 is, in turn, affixed to the hull portion 52 by a threaded fastener 56 with a backing plate 67 and elastic isolator 68 being interposed between the assembly and the hull 22 so as to reduce vibration and noise.

Figure 5:
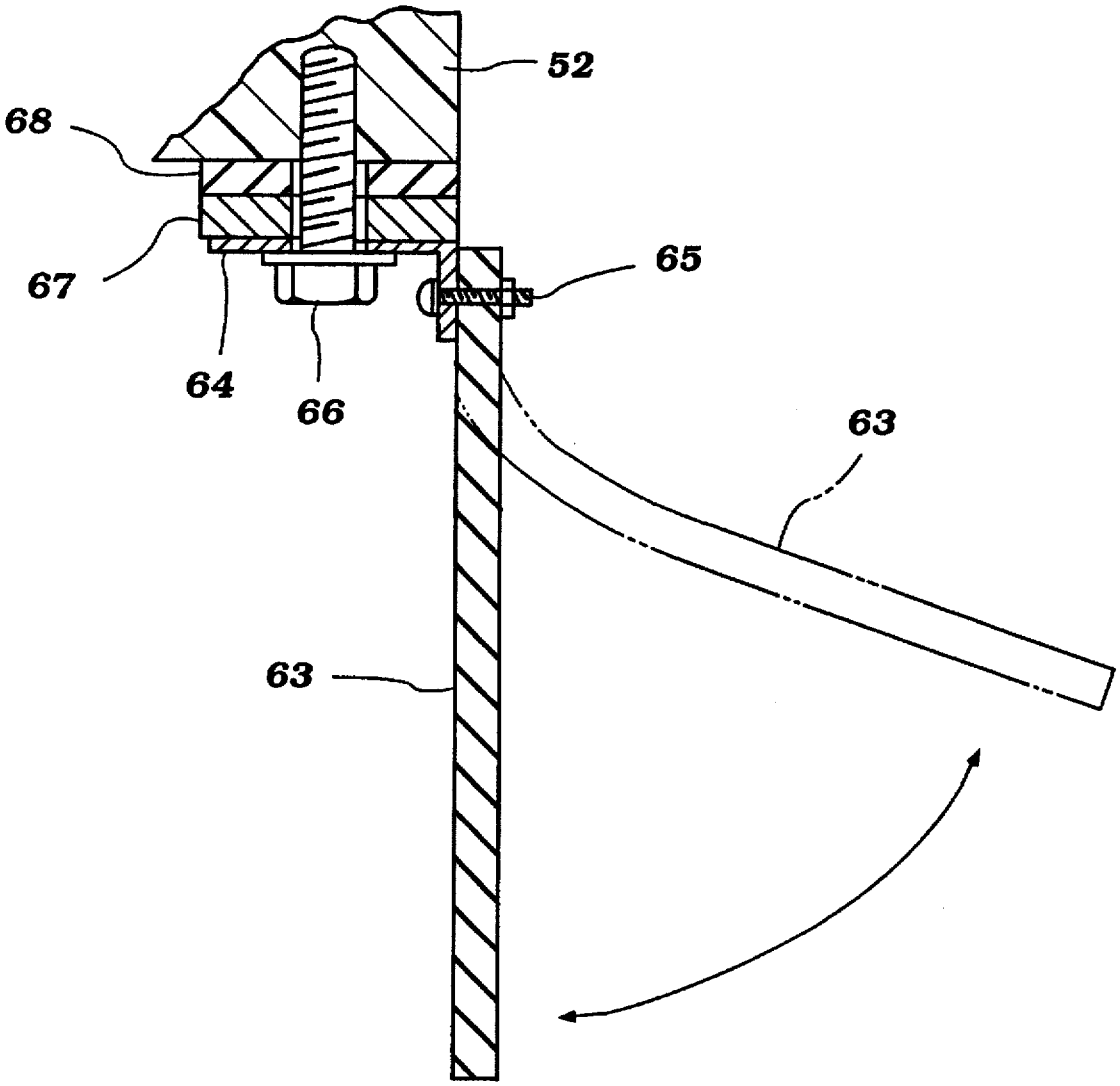
FIG. 5 is an enlarged cross-sectional view taken along the line 5—5 of FIG. 2 and shows another of the silencing devices.

It should be noted that when the engine is running at low and mid ranges, the flap type valve element 63 will be normally closed so as to provide some sound deadening and to cause the exhaust gases to exit through smaller openings formed around the flap type valve 63. However, as the flow of exhaust gases increases due to increasing speed of the engine, the valve element 63 may swing to an open position as shown in FIG. 5. This will still provide some silencing effect but will also reduce back pressure.

Figure 3:
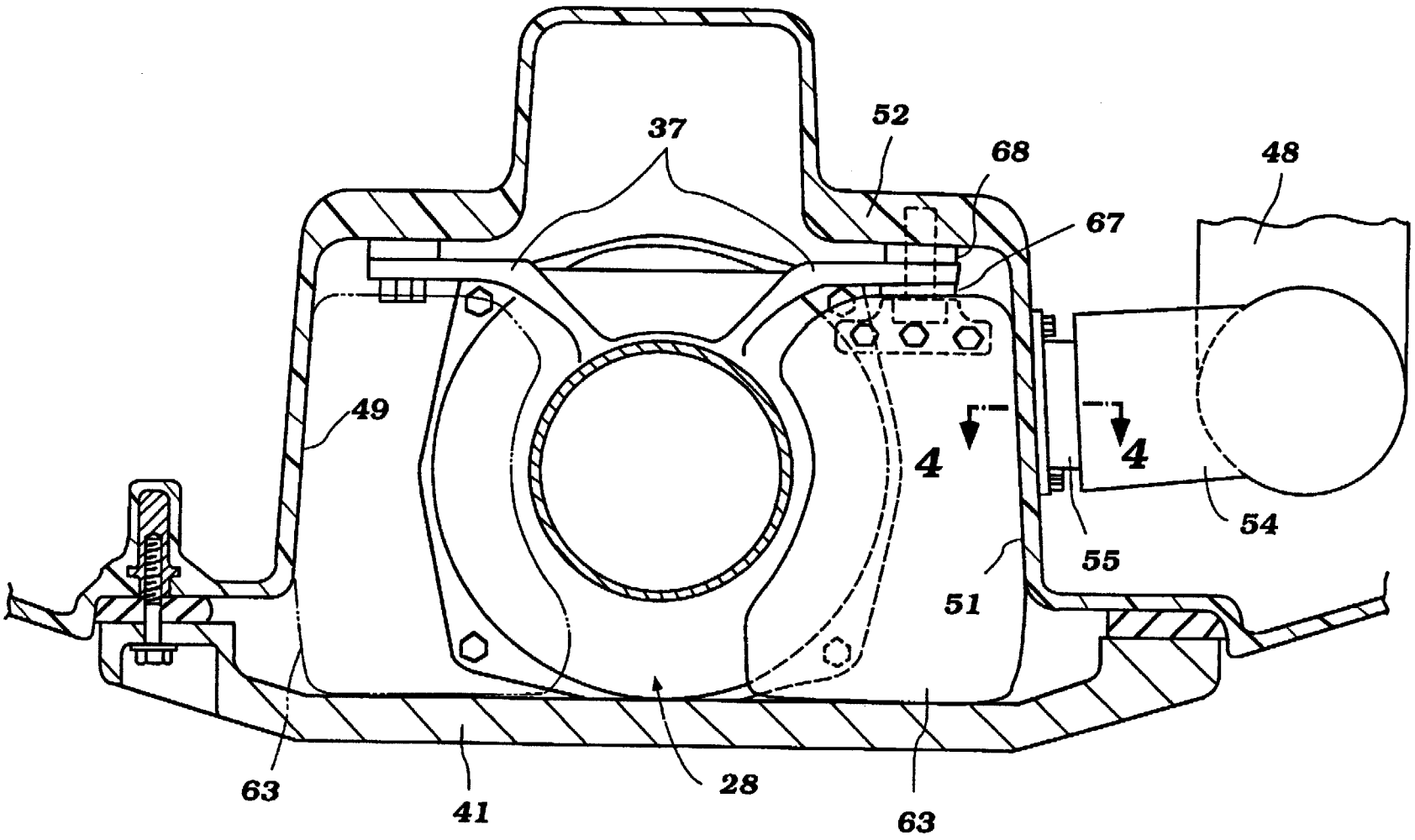
FIG. 3 is a cross-sectional view taken along a plane perpendicular to the plane of FIG. 2 and is on a larger scale.

If desired, a further flap type valve assembly 63 may be disposed on the opposite side of the tunnel opening and mounted in the same way as shown by the phantom line views in FIGS. 2 and 3.

Figure 6:
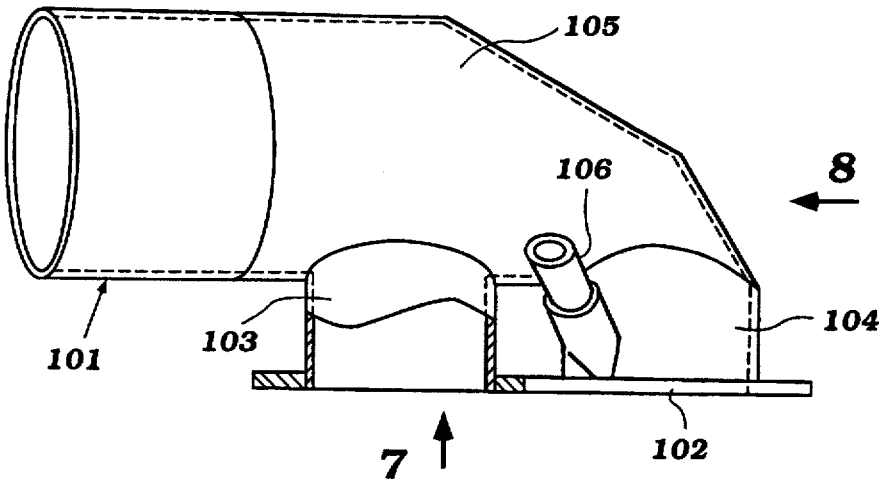
FIG. 6 is a partial view, in part similar to FIG. 2 and shows a further embodiment of the invention, with a portion broken away.
Figure 7:
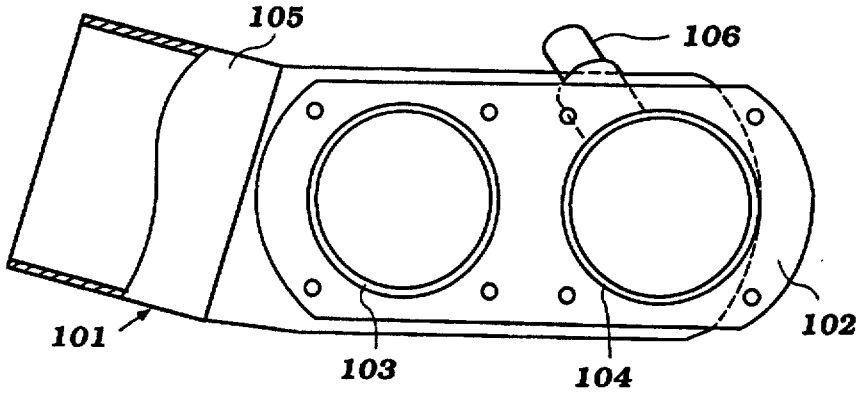
FIG. 7 is a view taken in the direction of the arrow 7 in FIG. 6.
Figure 8:
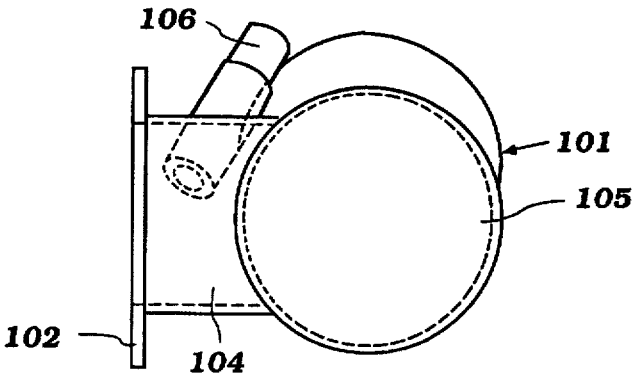
FIG. 8 is a view taken in the direction of the arrow 8 in FIG. 6.

FIG. 6–8 show another embodiment of the invention which differs from the embodiment of FIGS. 1–5 only in the way the exhaust gases are delivered to the tunnel 27. For that reason, only the discharge fitting of this embodiment, which is indicated generally by the reference numeral 101, is illustrated and will be described. This includes a flange 102 that is affixed to the side wall 51 and thus eliminates the necessity of the fittings 55 of the previously described embodiment. This flange 102 is provided with a pair of circular sections 103 and 104 which are obviously spaced at different distances from the transom 52 since they are longitudinally spaced from each other. As previously described, the sections 103 and 104 may be the same or of a different size, depending upon the effect desired.

The circular sections 103 and 104 are integrally connected to a collector section 105 which has a flange for receiving the U-pipe 48 and the exhaust gases therefrom. Either in addition to a flap type valve like the valve 56 of the previously described embodiment or in lieu of it, there is provided a water fitting 106 that communicates with the circular section 104 and which receives all or part of the coolant from the engine. This water will flow as a curtain transversely across the opening of the portion 104 and will obstruct the exhaust gas flow through it until the exhaust pressure is high. Thus, this water may itself act as a valve and eliminate the necessity of the flap type valve, as aforenoted. However, this water flow will effect silencing even when the engine is operating at high speeds and the exhaust gases can exit through the cylindrical section 104.

Figure 9:
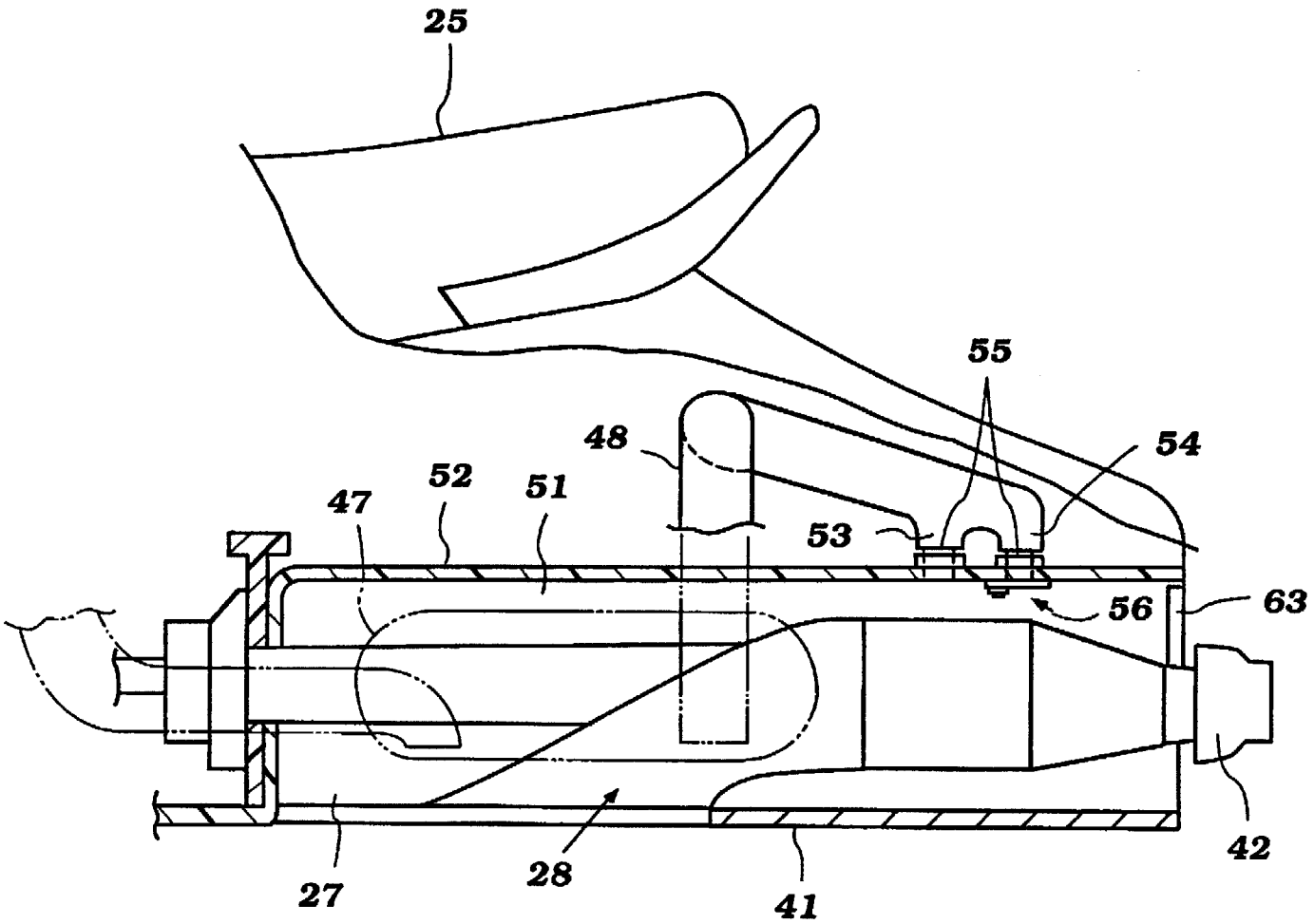
FIG. 9 is a partial view, in part similar to FIG. 1, but showing only the rear portion of the watercraft constructed in accordance with another embodiment of the invention.

FIG. 9 illustrates another embodiment which is generally the same as the embodiment of FIGS. 1–5 and hence components of this embodiment are identified by the same reference numerals where they perform the same function even though they may be shaped slightly differently. In this embodiment, the sections 53 and 54, rather than entering the tunnel 27 through the side wall 51, enter through the top wall 52. In all other regards, this embodiment is the same as that previously described. Because of the high entry of the exhaust gases into the tunnel area 27, the likelihood of water intrusion will be substantially reduced. This is so even though the openings of the previously described embodiment enter the tunnel area 27 above the water level under all running conditions of the watercraft 21.

Figure 11:
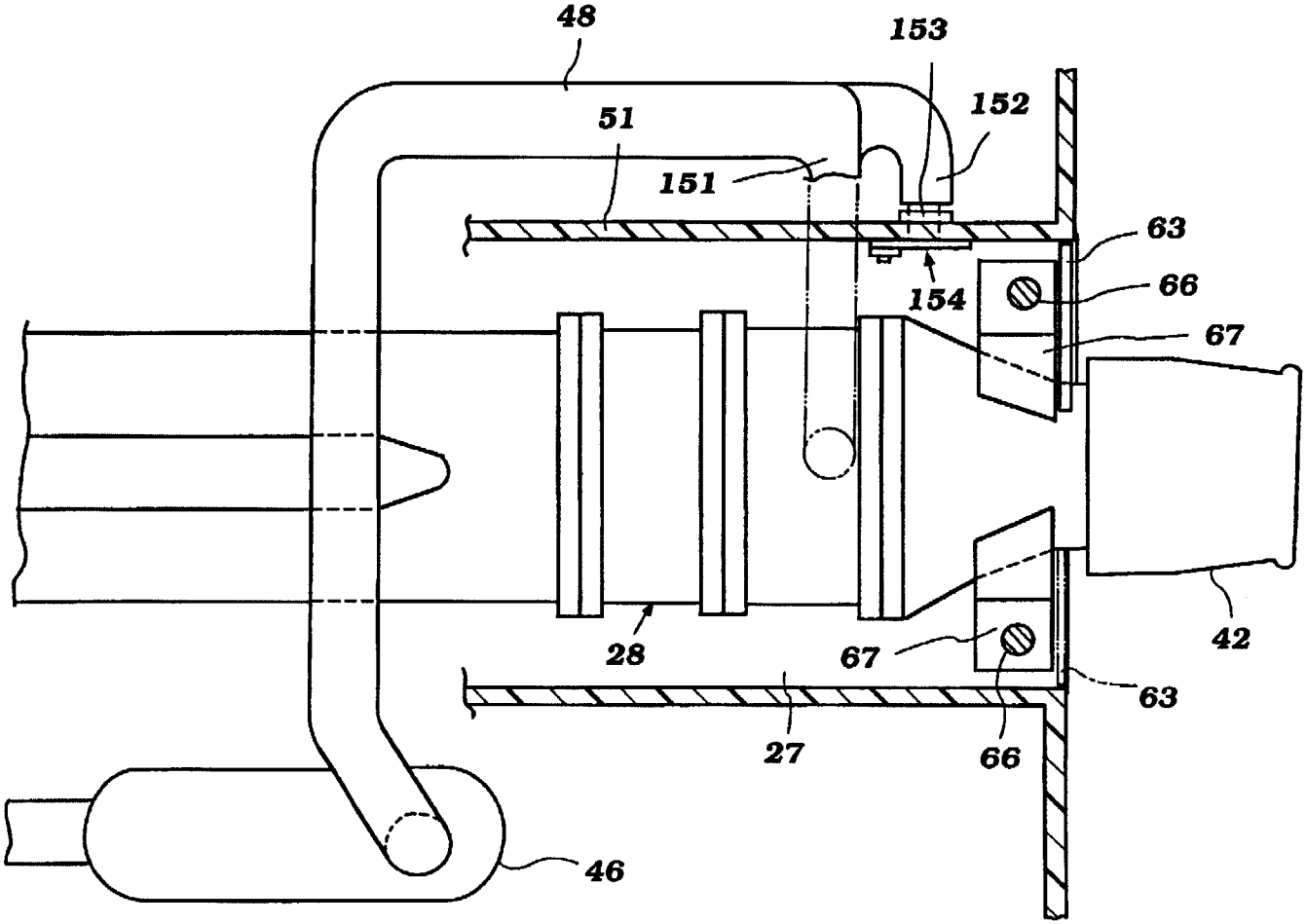
FIG. 11 is a cross-sectional view, in part similar to FIGS. 2 and 9 and shows a still further embodiment of the invention.

FIG. 11 shows another embodiment which differs from the previously described embodiments only in the way in which the exhaust gases are delivered to the tunnel area 27. For that reason, only the differences in the construction will be described and components which are the same as those previously described are indicated by the same reference numerals. Also, only a portion of the watercraft is illustrated, this being the portion where the exhaust gases enter the tunnel.

Figure 10:
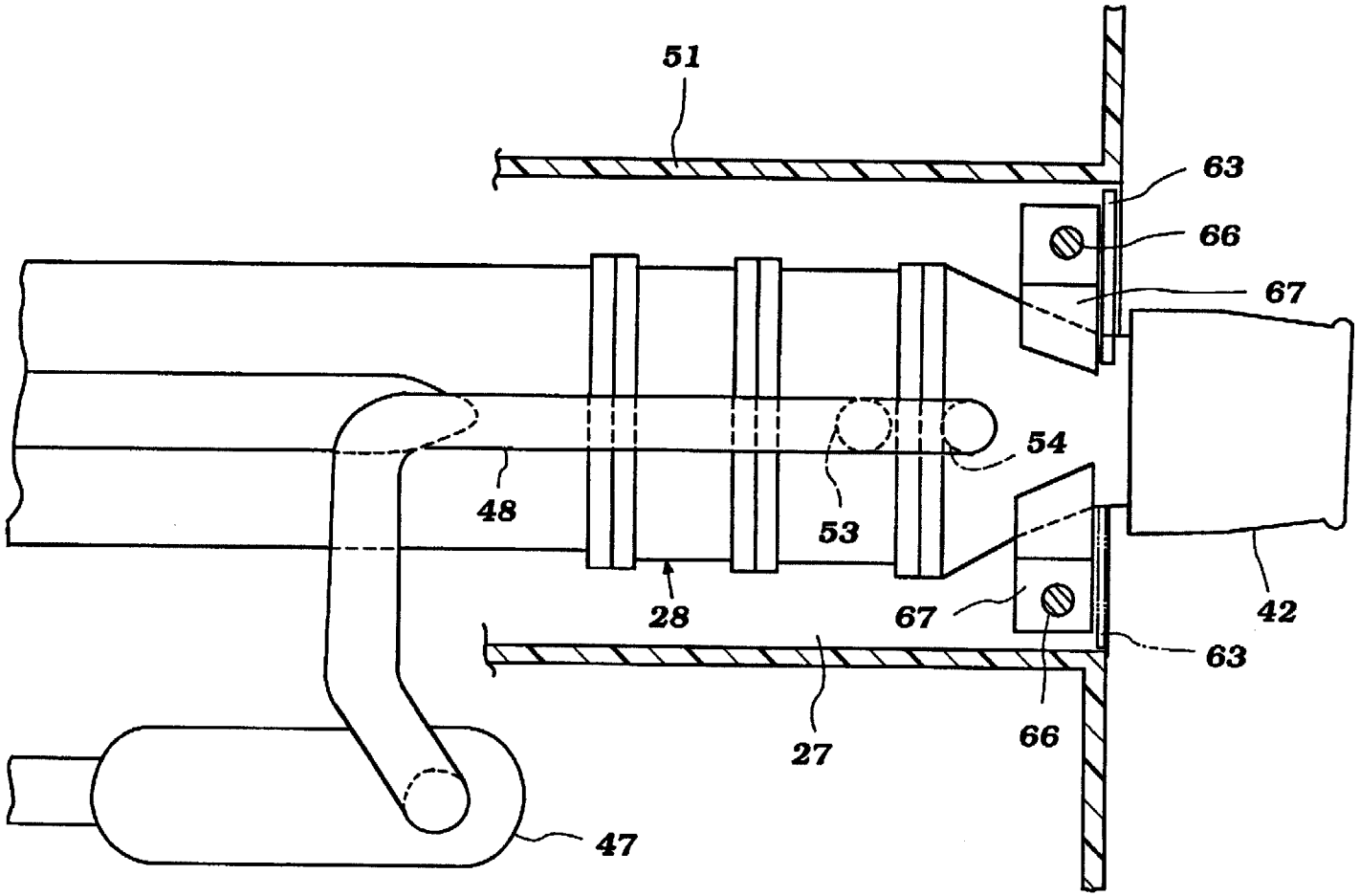
FIG. 10 is a cross-sectional view taken along a horizontal plane, in part similar to FIG. 2, of the embodiment of FIG. 9.

In this embodiment, the U-shaped pipe 48 has two branch sections, a forward branch section 151, which extends back across the top of the tunnel 27 above the upper wall 52 and then turns downwardly to enter the tunnel 27 through the upper wall 52 in the same manner as the forward opening 53 of the embodiment of FIGS. 9 and 10. There is provided a further branch 152 that extends along the side wall 51 and cooperates with a fitting 153 therein to deliver the exhaust gases to the tunnel 27 through the wall 51 and rearwardly of the portion 151. A flap type valve 154 is positioned across the opening of this rear fitting 153 to normally close it until the exhaust gas pressure becomes high enough due to increased engine speed.

The embodiments of FIGS. 9 and 10 and FIG. 11 have both employed flap type valves which, as have been noted, can be employed also with the embodiment of FIGS. 6–8. Alternatively, these embodiments may use the water curtain type of flow control as shown in the embodiments of FIGS. 6 and 7 either with or without a flap type valve.

It should be apparent from the foregoing description that the described embodiments of the invention provide very effective silencing for the exhaust gases of a watercraft without increasing the back pressure. Of course, the foregoing description is that of preferred embodiments of the invention and various changes and modifications may be made without departing from the spirit and scope of the invention, as defined by the appended claims.

We claim:

1. A watercraft comprised of a hull defining a tunnel in the underside thereof opening to the atmosphere through the hull, a propulsion unit for propelling said watercraft contained at least partially within said tunnel, an internal combustion engine supported within said hull and driving said propulsion unit, said engine having at least one exhaust port, exhaust pipe means for delivering exhaust gases from said exhaust port to a pair of exhaust openings spaced from each other, and flow control means for controlling the flow of exhaust gases through said openings to restrict exhaust gas flow through at least one of said openings under a watercraft low speed operating condition and to permit flow through both openings under a watercraft high speed operating condition.

2. A watercraft as set forth in claim 1 wherein the exhaust openings are spaced vertically from each other.

3. A watercraft as set forth in claim 2 wherein one of the exhaust openings is formed in sidewall of the tunnel in proximity to the water level and the other of the openings is formed in an upper portion of the hull that defines the tunnel.

4. A watercraft as set forth in claim 3 wherein the other opening is formed in the upper wall of the tunnel.

5. A watercraft as in claim 1, wherein the exhaust openings are formed in at least one wall of the hull.

6. A watercraft as in claim 5, wherein at least one of the exhaust openings is formed in a side wall of the tunnel.

7. A watercraft as in claim 5, wherein at least one of the exhaust openings is formed in a upper wall of the tunnel.

8. A watercraft as in claim 1, wherein said exhaust pipe means includes a water trap device positioned upstream of said exhaust openings.

9. A watercraft as in claim 8, wherein the water trap device is positioned on one side of the tunnel and at least one of the exhaust openings is positioned on the other side of the tunnel.

10. A watercraft as in claim 1, wherein said flow control means cooperates with only one of said exhaust openings.

11. A watercraft comprising a hull defining a tunnel in the underside thereof opening to the atmosphere through said hull, a propulsion unit for propelling said watercraft contained at least in part within said tunnel, an internal combustion engine supported within said hull and driving said propulsion unit, said engine having at least one exhaust port, and an exhaust system for discharging exhaust gases from said exhaust port to the atmosphere, the exhaust system including an exhaust pipe communicating with at least first and second vertically spaced exhaust openings, the first opening being contiguously formed with an upper wall of said tunnel and the second opening being contiguously formed in a wall of the hull at a level below the first opening, the second opening being at least partially obstructed by water under low speed operating conditions of the watercraft.

12. A watercraft as in claim 11, wherein the second opening is located on a side wall of the tunnel.

13. A watercraft as in claim 11, wherein a curtain of water provided by an engine cooling system at least partially obstructs the second opening under low speed operating conditions of the watercraft.

14. A watercraft as in claim 11, wherein the exhaust pipe includes a first branch and a second branch which communicate with the first and second openings, respectively.

15. A watercraft as in claim 14, wherein the exhaust system additionally includes a water trap device, and the first and second branches of the exhaust pipe are located downstream of the water trap device in the exhaust system.

16. A watercraft as in claim 11 additionally comprising means for controlling the flow of exhaust gases through said openings to restrict exhaust gas flow through the second opening under a low speed operating condition of the watercraft and to permit exhaust gas flow through both the first and second openings under a high speed operating condition of the watercraft.

17. A watercraft as in claim 11 additionally comprising a flow controller to selectively restrict the flow of exhaust gases through at least one of said first and second openings.

18. A watercraft as in claim 17, wherein the flow controller comprises a flap type check valve.

* * * * *